United States Patent [19]

Cabak

[11] 4,135,828

[45] Jan. 23, 1979

[54] MIXING APPARATUS

[76] Inventor: James E. Cabak, 3 N 909 Wildrose Rd., St. Charles, Ill. 60174

[21] Appl. No.: 854,791

[22] Filed: Nov. 25, 1977

[51] Int. Cl.[2] ..... B01F 11/00

[52] U.S. Cl. ..... 366/197; 366/222; 366/224

[58] Field of Search ..... 366/197, 198, 199, 200, 366/204, 205, 206, 207, 187, 207, 208, 209, 220, 219, 222, 224

[56] References Cited

U.S. PATENT DOCUMENTS

| | | | |
|---|---|---|---|
| 2,652,983 | 9/1953 | Hall | 366/224 |
| 3,380,671 | 4/1968 | Kubodera | 366/222 |

*Primary Examiner*—Edward J. McCarthy
*Attorney, Agent, or Firm*—Edmond T. Patnaude

[57] ABSTRACT

A support member having a drive motor on one side and a mixing element on the other is journaled in a frame to permit sealable attachment of an open topped mixing vessel thereto over said mixing element and subsequent inversion thereof prior to mixing.

6 Claims, 4 Drawing Figures

MIXING APPARATUS

The present invention relates in general to apparatus for mixing various types of materials such as liquids, powders and the like, and it relates in particular to mixing apparatus which is suitable for industrial uses.

BACKGROUND OF THE INVENTION

High intensity mixers commonly incorporate a mixing vessel having a rotary mixing element mounted near the bottom of the vessel and coupled by a suitable mechanism to a drive motor. Various means have been devised for removing the material from the vessel after mixing. These designs have included valved conduits connected to the bottom of the mixing vessel, means for tilting the vessel to pour the mixture therefrom and the use of a disconnectable coupling between the mixing element in the container and the drive motor. When using any of these prior art mixers, cleanup of the equipment can be difficult and time consuming and sterilization of the mixer can be particularly difficult if not impossible.

SUMMARY OF THE INVENTION

Briefly, there is provided in accordance with the present invention a new and improved mixer wherein the mixing vessel is a simple open top container which, after being filled with the ingredients to be mixed, is sealably secured in an upright position over a mixer element which depends from a support member. A drive motor is carried by the support member which is mounted by trunnions in a support frame so that after the vessel has been secured in place the entire mixing assembly can be inverted prior to energizing the motor to drive the mixing element. After completion of the mixing operation the assembly is rotated back to the original position and the vessel is removed.

Several of the more important operating advantages of this novel mixer are:

(1) The vessel and mixer element can be easily cleaned and sterilized.

(2) The angle of tilt of the vessel during the mixing operation is selectable.

(3) The mixing element can be easily removed for cleaning or installation of different elements for different applications.

GENERAL DESCRIPTION OF THE DRAWING

A better and more complete understanding of the present invention may be had from a reading of the following detailed description taken in connection with the accompanying drawing wherein.

DETAILED DESCRIPTION OF THE DRAWING

Figure 1:
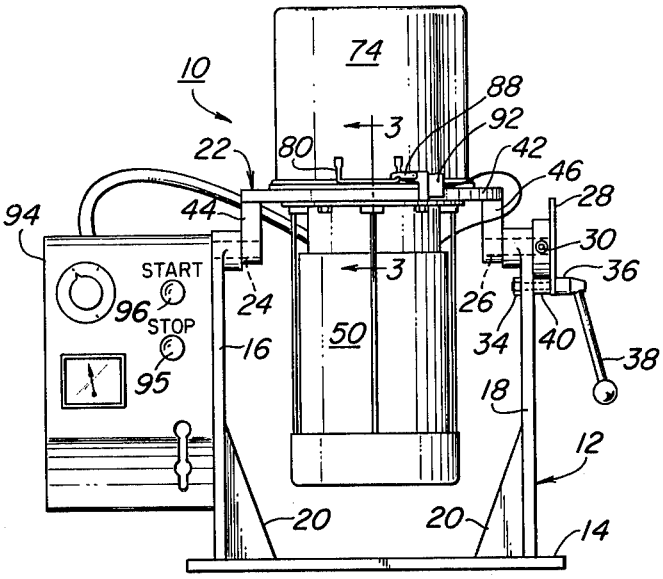
FIG. 1 is a front elevational view of a mixing apparatus embodying the present invention, the apparatus being illustrated in the mixing position.
Figure 2:
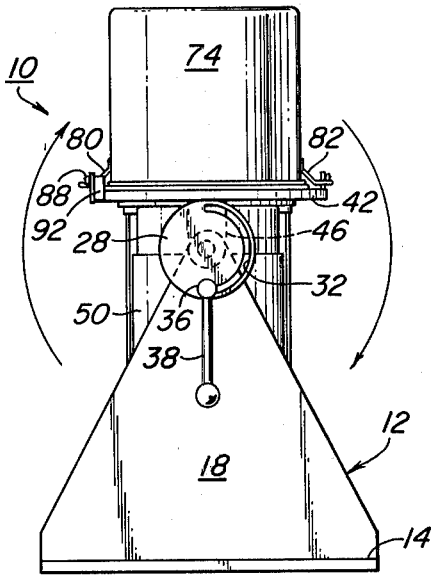
FIG. 2 is an elevational view of the mixing apparatus shown in FIG. 1 taken from the right hand side thereof.

Referring particularly to FIGS. 1 and 2, a high intensity, industrial type mixer 10 includes a main support frame 12 made up of a base plate 14 and a pair of generally triangular uprights 16 and 18. The uprights are suitably fastened to the base plate and held in position by a plurality of braces 20.

A support member 22 is rotatably journaled to the upper end portions of the uprights 16 and 18 on a pair of horizontal trunnions or shafts 24 and 26. The shaft 26 extends a substantial distance outwardly of the upright 18 and a circular plate 28 is secured thereto by a screw 30. An arcuate slot 32, concentric with the shafts 24 and 26, is provided in the plate 28, and a bolt 34 extends from the upright 18 through the slot 32. A nut 36 is threaded onto the outer end of the bolt 34 and has a hand lever 38 extending therefrom to lock the plate 28 and the support 22 in a selected angular position by clamping the plate 28 between the nut 36 and a sleeve 40 positioned over the shank of the bolt 34.

The support member 22 is fabricated from a generally circular metal plate 42 having vertically extending legs 44 and 46 welded to one side thereof in mutually parallel, diametrically opposite relationship. A drive motor 50 is bolted to one side of the support plate 42 with the motor shaft 52 extending through a bearing sleeve 54 disposed in a central hole 56 in the plate 42. A cover plate 58 is fastened to the upper side of the support plate 42 by means of a plurality of screws 60 and has a central hole through which the sleeve 54 extends. A mixing element 62 is held in place on the motor shaft by a cap nut 64 and includes a plurality of mixing blades 66. In order to prevent relative rotation between the motor shaft and the mixing element the upper end of the shaft 52 is square in cross-section and the central hole in the mixing element is complimentary thereto.

The cover plate has an annular upstanding portion 68 having a cylindrical outer wall surface 70 and an arcuate inner surface or fillet 72 which blends smoothly with the inner cylindrical wall of a mixing vessel 74 when the vessel is mounted to the support member 22 as shown in the drawing. The inner diameter of the vessel 74 is substantially equal to the outer diameter of the wall surface 72 and the vessel has an external lip 76 which tightly fits against the horizontal peripheral surface portion 78 of the cover plate 58 when the vessel is clamped to the support member.

Figure 3:
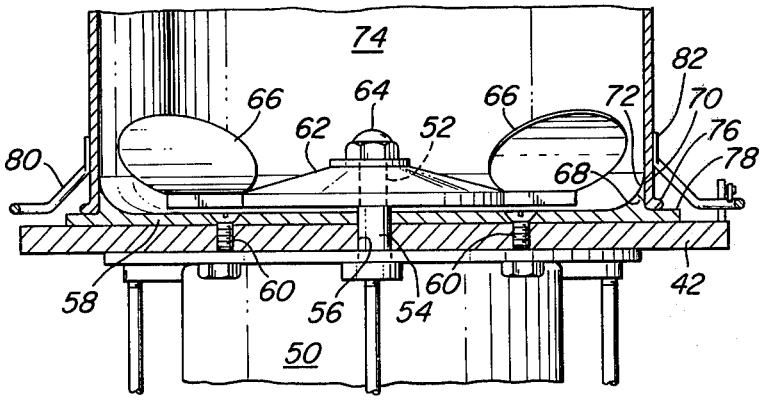
FIG. 3 is an enlarged vertical section taken along the line 3—3 of FIG. 1.
Figure 4:
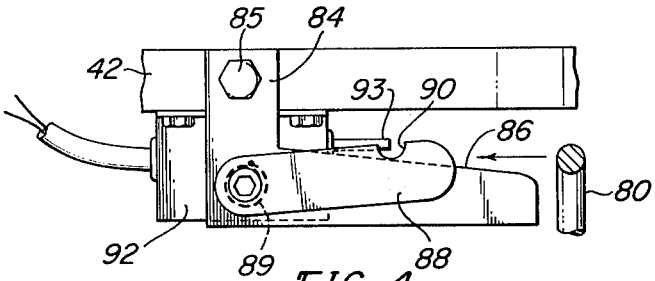
FIG. 4 is an enlarged view of the latching mechanism used to lock the mixing vessel to the mixer assembly.

In order to clamp the vessel 74 to the support member over the mixer element 62 and the cover plate 58, any suitable clamping mechanism may be used. However, in accordance with one aspect of the present invention the two handles 80 and 82 provide a portion of the clamping mechanisms. As best shown in FIGS. 3 and 4 a pair of clamp brackets 84 are fastened to the edge of the support plate 42 as by bolts 85 and each bracket 84 includes a sloping cam surface 86 along which the handles 80 and 82 ride as the vessel is rotated in a clockwise direction as viewed from the bottom in FIG. 4 to move the rim 76 of the vessel against the cover plate surface 78. A latch member 88 is pivotally mounted to the bracket 84, and a coil spring 89 biases the member 88 in a counter-clockwise direction as viewed in FIG. 4. The latch member 88 includes a notch 90 for receiving the associated handle on the vessel to prevent inadvertent removal of the vessel from the support member. Consequently, when the vessel is rotated against the cover plate the horizontal portions of the handles 80 and 82 ride up on the cam surfaces 86 to force the rim 76 tightly against the cover plate surface 78.

A normally open switch 92 is mounted on one of the brackets 84 and includes an actuator 93 which closes the switch 92 when the actuator 93 is pressed to the left as shown in FIG. 4 by the handle 80 when the vessel is locked in place. The switch 92 is serially connected in the power circuit to the motor 50 to prevent inadvertent operation of the mixer when the vessel is not in place.

OPERATION

In use, the support member 22 is locked in place by the nut 36 with the motor 50 at the top. The materials to be mixed are placed in the bucket-like vessel 74 which is then lifted against the cover plate 58 and clamped in place by rotating the vessel in a clockwise direction as viewed from the bottom. The latches 88 thus lock the vessel in place and the switch 92 is closed to condition the mixer for operation.

The nut 36 is then loosened and the support is rotated about the axis of the shafts 24 and 26 into an inverted position wherein the mixer element 62 is submerged in the material to be mixed. This position may be the vertical position shown in FIGS. 1 and 2 or it may be in a tilted position depending on the materials to be mixed. With the support in the selected inverted position the nut 36 is tightened onto the bolt 34 to lock the support in position. A start switch actuator button 96 on a control box 94 mounted on the upright 16 is then pressed to energize the motor 50 and commence the mixing operation.

After the expiration of an appropriate mixing period, the support member may be rotated into the position shown in FIGS. 1 and 2 so that the mixer element is at least partially cleaned by centrifugal force and the stop button 95 is then actuated to deenergize the mixer. If desired, the mixer may be deenergized while the vessel 74 is still at the top.

After the mixer element has stopped rotating and the vessel 74 is at the bottom, the latches 88 may be released and the vessel rotated relative to the cover plate 58 to release it from the cover plate. For cleaning, a cleaning solution may be placed in the vessel and the above described mixing operation repeated thereby to clean the vessel, the cover plate and the mixing element. Alternatively, the mixer element can be removed for cleaning.

The mixer 10 employs an electric drive motor 50 which is relatively heavy. Consequently, the support plate 22 is offset from the pivot axis of the trunnions 24 and 26 so as to counter-balance the system to facilitate the manual rotation thereof with the vessel 74 in place. If desired, the electric drive motor may be replaced with any other suitable drive motor such, for example, as a pneumatic or hydraulic motor.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. Mixing apparatus, comprising
a support frame,
a support member,
a motor carried by said support member on one side thereof,
a mixing element extending from the other side of said support member and drivingly connected to said motor,
a mixing vessel having an open top and a closed bottom,
means for sealably securing said open top of said vessel to said other side of said support member over said mixing element,
trunnion means extending from said support member and journaled in said frame for enabling said support member to be at least partially inverted after said vessel has been secured thereto, and
locking means for locking said support member to said frame with said vessel in an inverted position.

2. Mixing apparatus according to claim 1 comprising
an annular fillet extending from said other side of said support member for disposition within said vessel in juxtaposition with the top edge of said vessel to deflect the material being mixed toward the closed bottom of said vessel.

3. Mixing apparatus according to claim 1, comprising
a plurality of handles on said vessel, and
said means for sealably securing said vessel to said support member comprises
cam means carried by said support member and cooperable with said handles to urge said vessel against said support member as said vessel is rotated relative to said support member.

4. Mixing apparatus according to claim 1 comprising
lockout means carried by said support member for preventing the operation of said motor unless said vessel is sealably secured to said support member.

5. Mixing apparatus according to claim 1 wherein
said support member is pivotable about a horizontal axis between a first position with said one side at the top and a second position with said one side at the bottom with said vessel directly beneath said motor.

6. Mixing apparatus according to claim 1 wherein
said locking means locks said support member in any selected one of a plurality of different inverted positions.

* * * * *